United States Patent [19]

Babberl

[11] 4,422,253

[45] Dec. 27, 1983

[54] MULTIPLE SEGMENTED DISPLAY DEVICE

[75] Inventor: Marion G. Babberl, San Mateo, Calif.

[73] Assignee: Rapid Mounting & Finishing Company, Chicago, Ill.

[21] Appl. No.: 414,969

[22] Filed: Sep. 7, 1982

[51] Int. Cl.[3] ..... G09F 19/14

[52] U.S. Cl. ..... 40/453; 40/539; 40/437

[58] Field of Search ..... 40/453, 615, 427, 436, 40/437, 454, 611, 571, 603, 604, 493; 493/955, 944, 959, 961

[56] References Cited

U.S. PATENT DOCUMENTS

| | | | |
|---|---|---|---|
| 660,190 | 10/1900 | Holley | 40/453 |
| 678,012 | 7/1901 | Maratta | 40/539 |
| 738,443 | 9/1903 | Henshaw | 40/617 |
| 824,860 | 7/1906 | Grove | 40/453 |
| 2,851,804 | 9/1958 | Roach | 40/539 |
| 3,758,972 | 9/1973 | Egermayer | 40/603 |
| 3,885,335 | 5/1957 | Egermayer | 40/603 |
| 4,025,673 | 5/1977 | Reinnagel | 40/453 |

FOREIGN PATENT DOCUMENTS

| | | | |
|---|---|---|---|
| 1372613 | 8/1964 | France | 40/453 |
| 611202 | 10/1960 | Italy | 40/453 |

*Primary Examiner*—John J. Wilson
*Assistant Examiner*—Cary Stone
*Attorney, Agent, or Firm*—Wood, Dalton, Phillips, Mason & Rowe

[57] ABSTRACT

A display device wherein a pleated sheet is retained in a carrier defining opposed pockets receiving the opposite ends of the pleated sheet. Stops are provided at opposite sides of the carrier for engagement by opposite side portions of the pleated sheet for limiting lateral expansion of the pleated sheet. The spacing between the stops is preselected to maintain the folds of the pleated sheet suitably compressed to have a height substantially equal to the depth of the pockets.

19 Claims, 10 Drawing Figures

MULTIPLE SEGMENTED DISPLAY DEVICE

BACKGROUND OF THE INVENTION

1. Field of the Invention

This invention relates to display devices and in particular to multiple segmented display devices.

2. Description of the Prior Art

Multiple segmented display devices are known wherein a sheet is scored and folded so as to present different displays depending on the position from which the device is viewed. Thus, one display is provided on alternating segments of the corrugations resulting from the pleating of the sheet and the other display is provided on the intermediate segments. In one form, the pleating is arranged to provide three different scenes, or displays, by a more complicated folding of the scored sheet.

If is further known to provide segmented displays in plastic-coated buttons and the like utilizing corrugated surfaces having the segmented displays viewable through the overlying transparent plastic surface material.

SUMMARY OF THE INVENTION

The present invention comprehends an improved segmented multiple display device which is simple and economical of manufacture and adapted for use in advertising displays and the like.

More specifically, the invention comprehends the provision of a display device including a pleated sheet defining a front corrugated surface and a rear corrugated surface, a first segmented display on first alternating portions of the front corrugated surface, a second segmented display on the second alternating portions of the front corrugated surface intermediate the first alternating portions, a third segmented display on first alternating portion of the rear corrugated surface, and a fourth segmented display on second alternating portions of the rear corrugated surface intermediate the third alternating portions.

Still further the invention comprehends the provision of a display device including a pleated sheet having a plurality of parallel folds defining corrugated front and rear surfaces, the folded sheets defining opposite ends and opposite sides, and a carrier defining a first end pocket for receiving one end of the folded sheet, an opposite second end pocket for receiving the opposite end of the folded sheet, and stop means at opposite sides thereof for engagement by opposite side portions of the folded sheet for limiting lateral expansion of the folded sheet, the spacing between the stop means being preselected to maintain the folds of the folded sheet suitably compressed to have a height substantially equal to the depth of the pockets, the carrier being constructed to expose at least one of the corrugated surfaces for forming a pair of segmented displays thereon.

In the illustrated embodiment, the pockets are substantially rectangular in cross section.

In the illustrated embodiment, the carrier comprises a one-piece element.

The carrier is provided with stop means on the opposite side edges thereof, and in the illustrated embodiment, the stop means comprises a wall receivable under the edge pleats of the display sheet.

The invention comprehends the provision of reflective surface portions on the corrugations for reflecting an image from the adjacent, opposite surface of the corrugations and thereby providing a quasi three-dimensional effect.

In one form, the carrier includes sidewalls defining side pockets for receiving the opposite side portions of the pleated sheet between the end pockets.

The carrier may be provided with means for supporting the display device in an upright disposition on a support surface. Alternatively, the carrier may be provided with means for hanging the display device from an overhead support.

The invention further comprehends the novel method of forming a display device including the steps of providing a resiliently pleated sheet with alternating segmented first and second displays on the opposite sides of the respective corrugations thereof, the sheet tending to expand laterally toward a planar configuration, inserting one end of the pleated sheet into a pocket, and forming a pocket about the other end of the pleated sheet, the pockets being configured to snugly retain the pleated sheet as a result of the tendency of the pleated sheet to expand.

In the disclosed method of forming one of the embodiments of the invention, a stop is urged under the edge pleats of the sheet to retain the edges of the sheet against further lateral expansion.

The stop may be inserted subsequent to the forming of the pocket about the other end of the pleated sheet.

The display device of the invention and method of forming the same is extremely simple and economical while yet providing an improved, novel display for use such as in advertising and the like.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
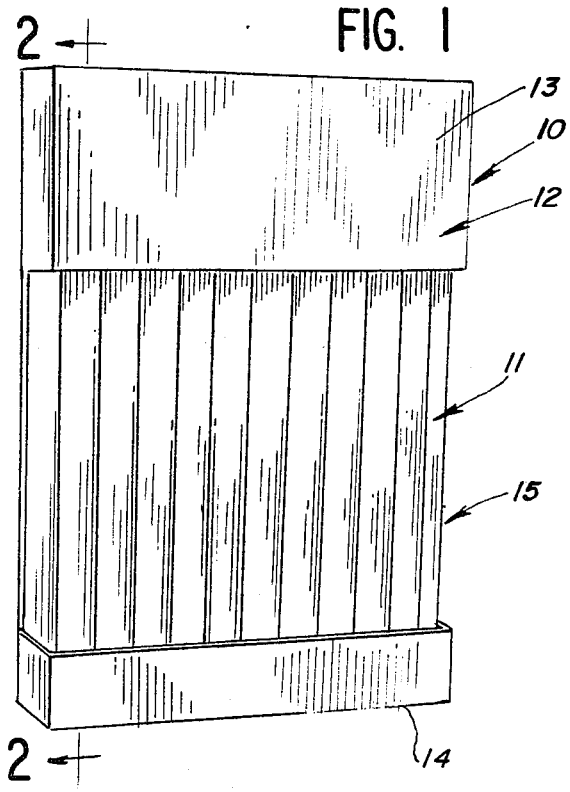
FIG. 1 is a perspective view of a display device embodying the invention.

In the exemplary embodiment of the invention as disclosed in FIGS. 1–4 of the drawing, a display device generally designated 10 is shown to comprise a pleated sheet generally designated 11 retained in a corrugated display configuration by a carrier generally designated 12.

As best seen in FIG. 1, carrier 12 defines an upper end portion defining a first pocket 13, and an opposite second lower end portion defining an opposite pocket 14. The upper end of the pleated sheet 11 is received in pocket 12 and the lower end is received in pocket 14 so as to expose a midportion generally designated 15 of the pleated sheet for presenting two segmented alternative displays depending on the position of the viewer.

Figure 4:
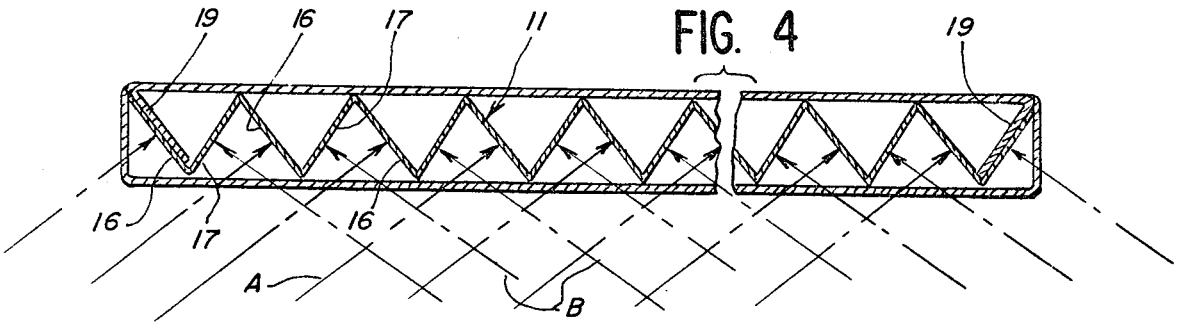
FIG. 4 is a fragmentary horizontal section taken substantially along the line 4—4 of FIG. 2.

More specifically, as seen in FIG. 4, the pleated sheet 11 defines first alternating corrugation surfaces 16 and second alternating corrugation surfaces 17 intermediate surfaces 16. Thus, when viewed from the direction of the arrows A. the display on surfaces 16 is seen, whereas when viewed from the direction of arrows B, the display on surfaces 17 is seen by the viewer.

The invention comprehends a novel arrangement of the carrier for retaining the pleated display sheet snugly in the carrier without the need for fastening means, such as adhesive, staples, etc. More specifically, as shown in FIGS. 3 and 4, the carrier defines a midportion 18 provided with stop means 19 at its opposite edges defined by upstanding walls. As shown in FIG. 4, the edge walls 19 are configured to be received within the side edge corrugations of the pleated sheet 11 so as to limit lateral expansion of the pleated sheet to the configuration illustrated in FIG. 4 wherein the height of the pleats is substantially equal to the depth of the pockets 13 and 14, as furthere shown in FIG. 2. Resultingly, the pleated sheet is snugly retained at each of its opposite ends in the pockets by the resilient tendency of the sheet itself to expand toward a planar configuration from the pleated configuration.

Figure 9:
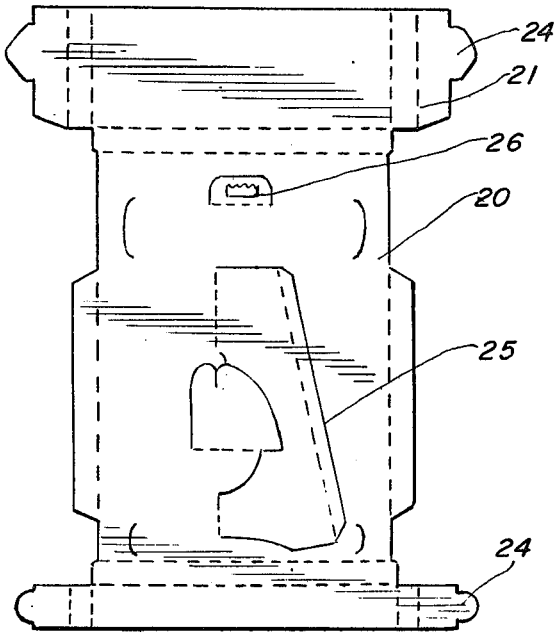
FIG. 9 is a plan view of a blank suitable for use in forming the carrier of the embodiment of FIG. 1.

As shown in FIG. 9, carrier 12 may be formed from a single sheet of suitable material, such as paperboard, defining a blank 20 having suitable score lines 21 for facilitating folding of the sheet into the carrier configuration. As illustrated in FIG. 3, the pocket 12 is firstly folded and secured, permitting the upper end 22 of the pleated sheet to be inserted into the pocket as a first step in the assembly of the display device.

Figure 2:
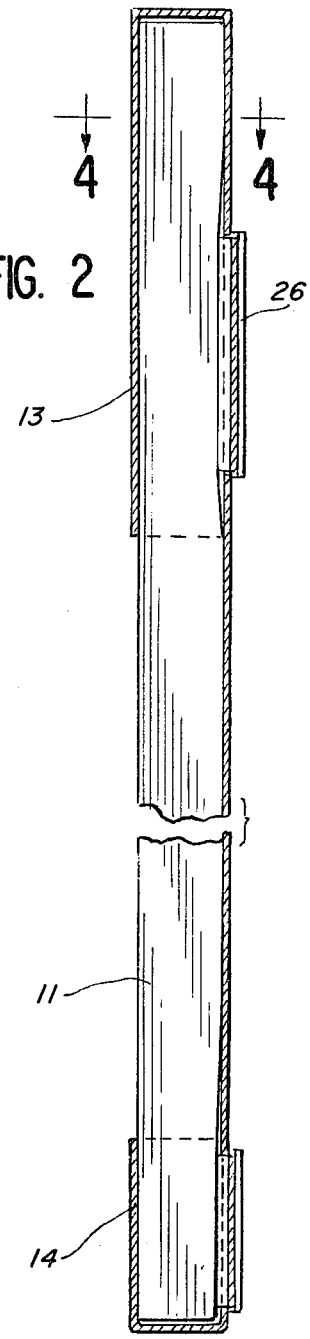
FIG. 2 is a fragmentary enlarged vertical section taken substantially along the line 2—2 of FIG. 1.
Figure 3:
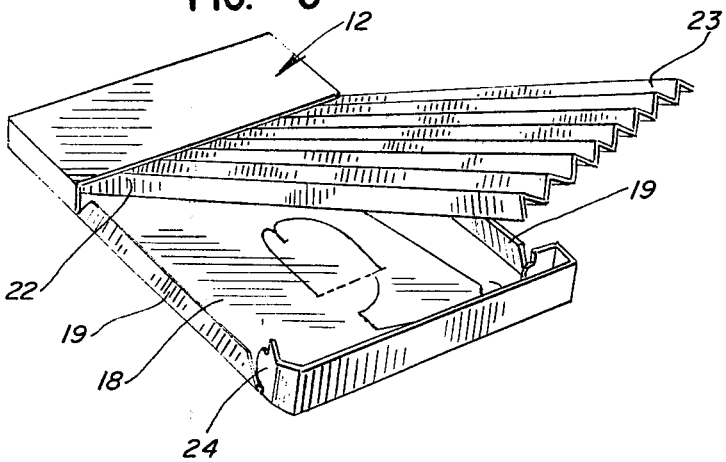
FIG. 3 is a perspective view illustrating a step in the assembly of the display device.

The folded sheet is then brought into juxtaposition to the carrier midportion 18 and the lower pocket 14 formed about the lower end 23 of the sheet, as seen in FIG. 2. The pocket portions of blank 20 are provided with suitable locking tab sections 24 for securing the blank portions in the pocket-forming configurations.

The final step in the assembly of the display device comprises a step of urging the stop walls 19 under the side portions of the pleated sheet to the configuration illustrated in FIG. 4, wherein the stop walls 19 limit further expansion of the midportion 15 of the pleated sheet and cooperate with the pockets 13 and 14 in effectively retaining the pleated sheet in display disposition in the device 10.

As best seen in FIG. 9, the blank 20 may be provided with suitable score lines to define an easel support 25 adapted to be pressed out of the carrier portion 18 and permit the display device to be self-standing on a subjacent support surface in the manner of a conventional easel-type photograph frame.

Thus, the display device 10 comprises an extremely simple and economical construction, being formed of two pieces of paperboard or the like suitably cut, scored and folded to define the improved structure wherein the display sheet is snugly retained in the carrier without the need for fastening means. Further, the assembly is readily and quickly effected. As indicated above, the easel support 25 permits the device to be set on a subjacent supporting surface. Alternatively, as seen in FIGS. 2 and 9, the rear wall of the carrier may be provided with a pushout wall hanging portion 26, permitting the carrier to be hung on a nail or hook so as to be wall-mounted when desired.

Referring to the embodiment of FIGS. 5–8 and 10, a modified form of display device generally designated 110 is shown to comprise a pleated sheet 111 received in a carrier 112. Carrier 112 defines an upper pocket 113 and a lower pocket 114 for receiving the upper and lower ends of the pleated sheet 111 in a manner generally similar to that of display device 10.

However, carrier 112 further defines side edge pockets 127 and 128 extending between end pockets 113 and 114. Thus, carrier 112 effectively defines a complete frame for the pleated sheet 111. Thus, in lieu of the stop walls 19 of device 10, the sidewalls 127 and 128 embrace the edge pleats of the display sheet 111 so as to effectively limit the lateral expansion of the pleated sheet upon reception in the frame carrier.

Figure 8:
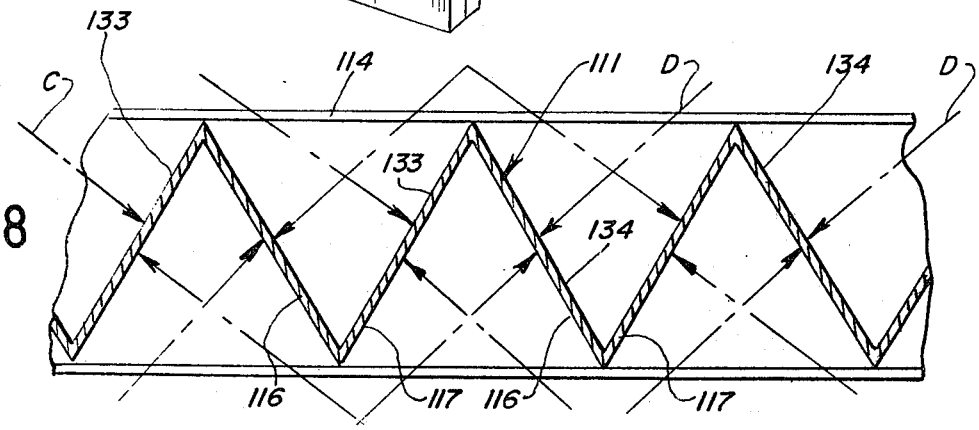
FIG. 8 is an enlarged fragmentary horizontal section taken substantially along the line 8—8 of FIG. 5.

The configuration of the carrier is made to cause the pleating of sheet 111 to have a height substantially equal to the depth of the pockets, as shown in FIG. 8.

Figure 5:
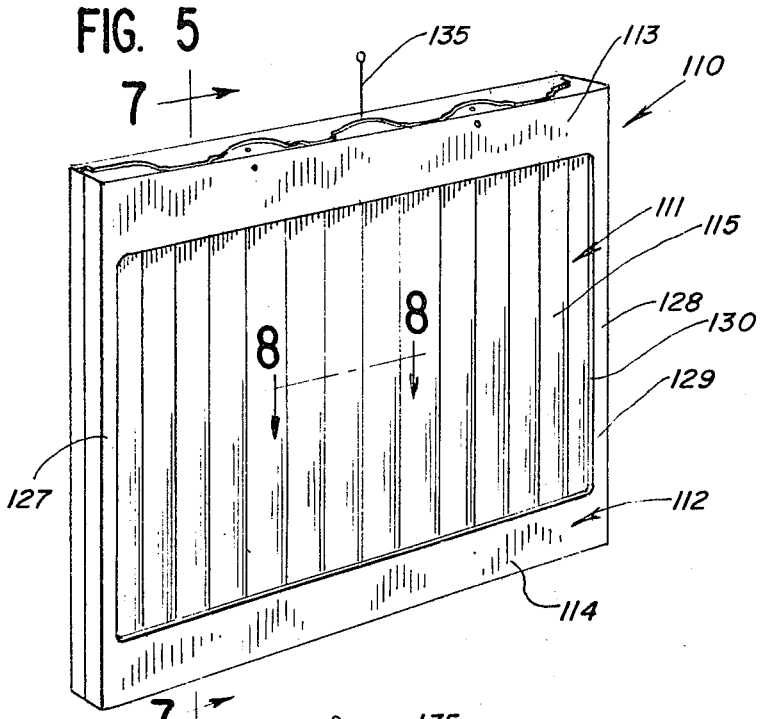
FIG. 5 is a perspective view of another form of display device embodying the invention.
Figure 7:
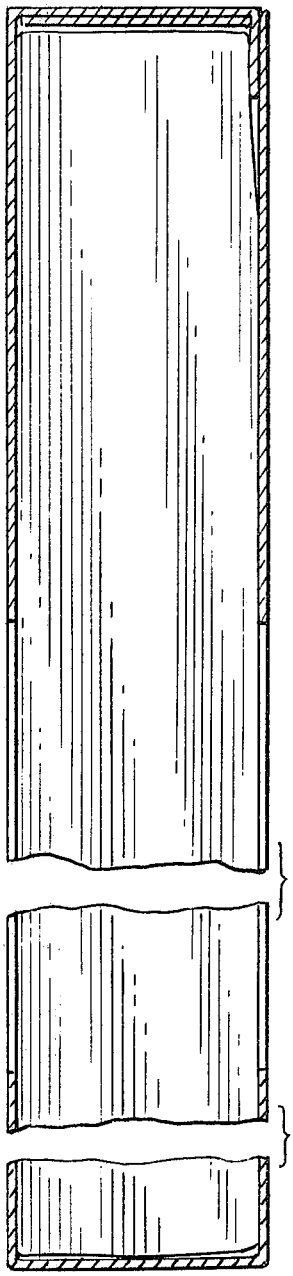
FIG. 7 is a fragmentary enlarged vertical section taken substantially along the line 7—7 of FIG. 5.
Figure 6:
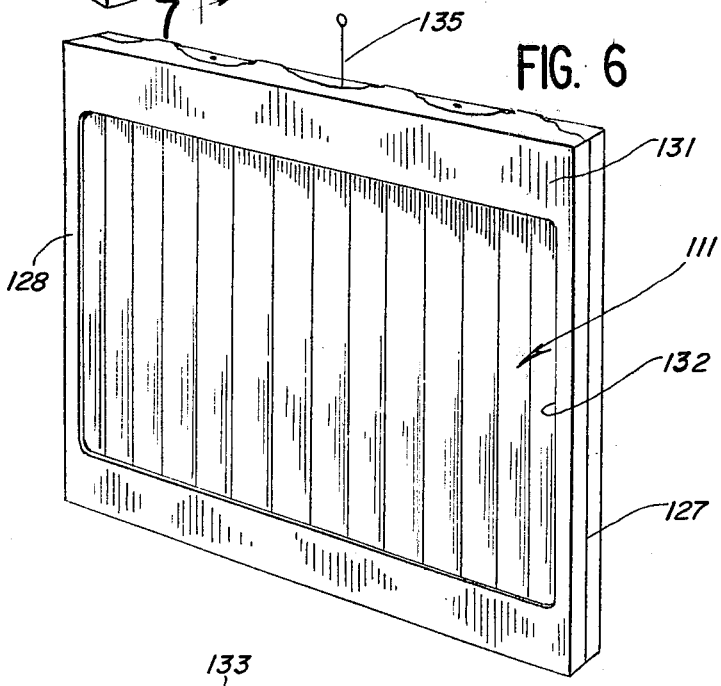
FIG. 6 is a perspective of the rear of the device as shown in FIG. 5.

As seen in FIGS. 5 and 6, the front wall 129 of the carrier is provided with an opening 130 exposing the midportion 115 of the pleated sheet and, as shown in FIG. 6, the rear wall 131 is provided with an opening 132 exposing the rear surface of the midportion 115. Thus, the display device 110 provides four different displays depending on the positioning of the viewer. More specifically, as seen in FIG. 8, the pleated sheet defines first alternating surfaces 116 and second alternating surfaces 117 intermediate surfaces 116 for providing two different displays viewable from the front of the device.

As further shown in FIG. 8, the rear surface of the display device defines alternating third surfaces 133 viewable in the direction of the arrows C and fourth surfaces 134 viewable in the direction of arrows D intermediate surfaces 133 so as to provide third and fourth displays selectively viewable depending on the position of the viewer looking at the rear of the display device through the window 132.

Display device 110 is advantageously adapted to be supported from an overhead support as by a hanger element 135 so that the display device is free to move relative to the viewer and thereby present the different displays with the viewer remaining in a single position. Thus, the display device 110 is advantageously adapted for use in presenting advertising displays which are uniquely attention-catching, while yet the display device is extremely simple and economical of construction.

Figure 10:
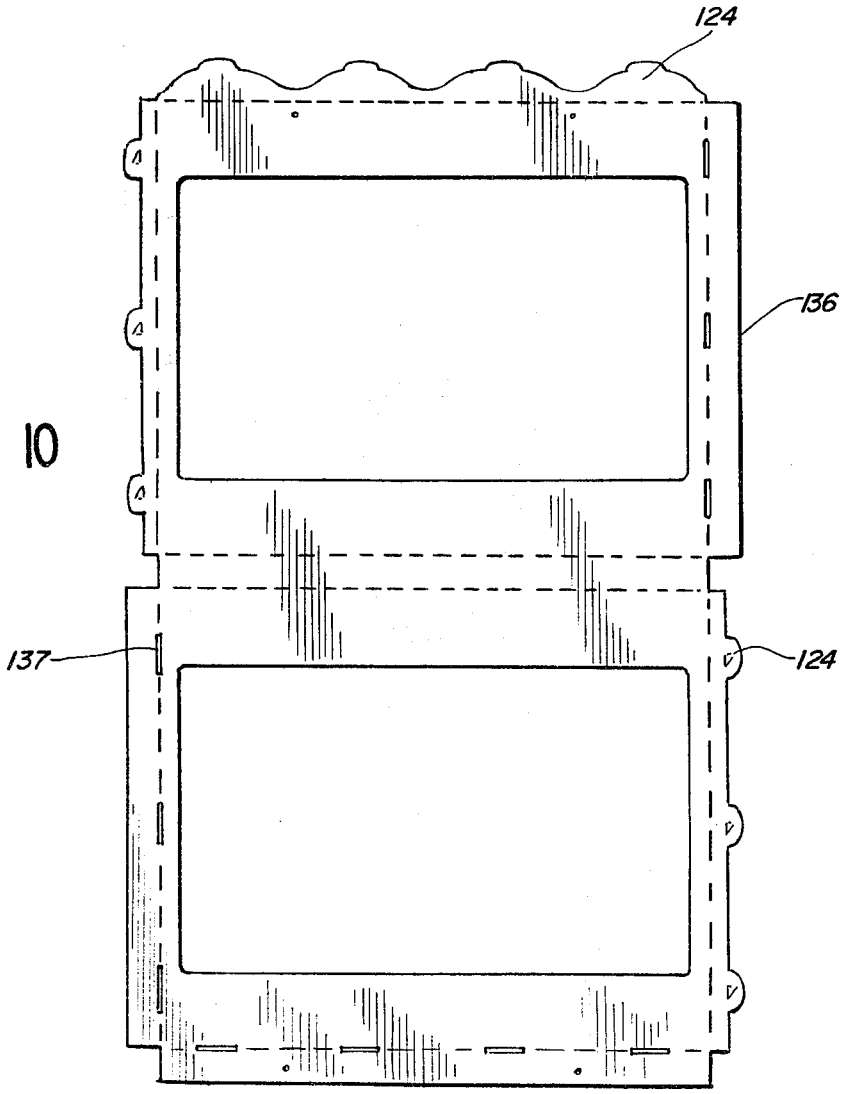
FIG. 10 is a plan view f a blank suitable for forming the carrier of the embodiment of FIG. 5.

Carrier 112 is adapted to be formed from a single sheet of material from a blank 136, as shown in FIG. 10, provided with score lines and slits so as to permit facilitated forming of the carrier from the blank by the user. As further illustrated in FIG. 10, the blank includes tabs 124 cooperating with suitable slits 137 for securing the blank in the carrier configuration without the need for additional securing elements.

Thus, display device 110 is similar to display device 10 in being formed of two novel elements which may be readily formed into the display device configuration by the user and readily assembled to form the desired configuration.

It should be noted that in the display device 10, while the carrier defines a rear wall 18 which would normally prevent observation of the rear surface of the pleated sheet, the sheet may be provided with displays on both the rear and front surfaces so that the display sheet may be selectively installed with either of the two faces thereof exposed forwardly for viewing of the two displays carried on the alternating corrugated surfaces thereof.

The foregoing disclosure of specific embodiments is illustrative of the broad inventive concepts comprehended by the invention.

I claim:

1. A display device comprising:

a pleated sheet having a plurality of parallel folds defining corrugated front and rear surfaces, the pleated folded sheet defining opposite ends and opposite sides; and a carrier defining a first end pocket for receiving one end of the pleated sheet, an opposite second end pocket for receiving the opposite end of the pleated sheet, and stop wall means at opposite sides thereof abutted by opposite side portions of the pleated sheet for limiting lateral expansion of the pleated sheet, the spacing between said stop wall means being preselected to maintain the folds of the pleated sheet at suitable angles to have a height substantially equal to the depth of said pockets for snug reception therein, said carrier being constructed to expose at least one of said corrugated surfaces for forming a pair of segmented displays thereon.

2. The display device of claim 1 wherein said pockets are substantially rectangular in cross section.

3. The display device of claim 1 wherein said stop wall means comprise upstanding sidewalls of the carrier.

4. The display device of claim 1 wherein said carrier comprises a one-piece element further defining a rear wall extending between said pockets.

5. The display device of claim 1 wherein said carrier comprises a one-piece element further defining a rear wall extending between said pockets and having an opening for exposing the rear corrugated surface.

6. The display device of claim 1 wherein said first end pocket has a height greater than that of the second end pocket.

7. The display device of claim 1 wherein each of said sheet and carrier comprises a one-piece element.

8. The display device of claim 1 wherein the stop wall means comprise sidewalls of the carrier underlying the edge pleats of the pleated sheet.

9. The display device of claim 1 wherein the corrugations are provided with reflective surface portions for reflecting an image from the adjacent opposite surface of the corrugation.

10. The display device of claim 1 wherein both said front and rear corrugated surfaces are exposed for forming a pair of segmented displays on both the front and rear of the device.

11. The display device of claim 1 wherein said stop wall means comprises sidewalls defining side pockets receiving the opposite sides of the pleated sheet between said end pockets.

12. A display device comprising:

a pleated sheet defining side edges, a front corrugated surface and a rear corrugated surface;

a first segmented display of first alternating portions of the front corrugated surface;

a second segmented display on the second alternating portions of the front corrugated surface intermediate said first alternating portions;

a third segmented display on first alternating portions of the rear corrugated surface;

a fourth segmented display on the second alternating portions of the rear corrugated surface intermediate said third alternating portions; and spaced sidewalls abutting said side edges to maintain said sheet against lateral expansion in a preselected pleated arrangement for displaying said displays.

13. The display device of claim 12 wherein a one-piece carrier is disposed in partially embracing relationship to the pleated sheet for retaining the sheet in the pleated configuration.

14. The display device of claim 12 wherein a one-piece carrier is disposed in partially embracing relationship to the pleated sheet for retaining the sheet in the pleated configuration, said carrier being provided with means for supporting the display device in an upright disposition on a support surface.

15. The display device of claim 12 wherein a one-piece carrier is disposed in partially embracing relationship to the pleated sheet for retaining the sheet in the pleated configuration, said carrier being provided with means for hanging the display device from an overhead support.

16. The method of forming a display device comprising the steps of:

providing a resiliently pleated sheet with alternating segmented first and second displays on the opposite sides of the respective corrugations thereof, said sheet tending to expand laterally toward a planar configuration;

inserting one end of the pleated sheet into a pocket; and forming a pocket about the other end of the pleated sheet, said pockets having side walls portions configured to snugly retain the pleated sheet therebetween in a preselected pleated configuration as a result of said tendency of the pleated sheet to expand laterally.

17. The method of forming a display device of claim 16 including the step of urging a stop wall under the edge pleats of the sheet to retain the edges of the sheet against further lateral expansion.

18. The method of forming a display device of claim 16 including the step of urging a stop wall under the edge pleats of the sheet subsequent to the forming of the pocket about said other end of the pleated sheet to retain the edges of the sheet against further lateral expansion.

19. The method of forming a display device of claim 16 including the step of providing said segmented displays on the corrugations at both the front surface and rear surface of the pleated sheet.

* * * * *